US005893800A

United States Patent [19]

Taggart

[11] Patent Number: 5,893,800

[45] Date of Patent: Apr. 13, 1999

[54] COMBINATION MARTIAL ARTS DEVICE

[76] Inventor: Bret Taggart, 11555 E. Kentucky Ave., Aurora, Colo. 80012

[21] Appl. No.: 09/019,018

[22] Filed: Feb. 5, 1998

[51] Int. Cl.[6] ..... F41B 15/02

[52] U.S. Cl. ..... 463/47.5; 463/47.6

[58] Field of Search ..... 463/47.2, 47.5, 463/47.6

[56] References Cited

U.S. PATENT DOCUMENTS

| | | | |
|---|---|---|---|
| 2,194,386 | 3/1940 | Dunaway | 463/47.5 |
| 3,454,274 | 7/1969 | Kaneshiro | 463/47.5 |
| 4,462,593 | 7/1984 | Carty, Jr. | 463/47.5 |
| 5,524,886 | 6/1996 | Kim | 463/47.5 |

*Primary Examiner*—William M. Pierce

[57] ABSTRACT

A new combination martial arts device for combining a nunchaku and tonfa into a single weapon. The inventive device includes a pair of elongated members. A pair of coupling bolts couple with the elongated members. The coupling bolts extend outwardly of the elongated members and have apertures therethrough inwardly of free ends thereof. A length of chain extends between the coupling bolts. The length of chain has free ends coupling with the apertures of the coupling bolts. A pair of handles extend outwardly from the elongated members.

4 Claims, 2 Drawing Sheets

COMBINATION MARTIAL ARTS DEVICE

BACKGROUND OF THE INVENTION

1. Field of the Invention

The present invention relates to martial arts weapons and more particularly pertains to a new combination martial arts device for combining a nunchaku and tonfa into a single weapon.

2. Description of the Prior Art

The use of martial arts weapons is known in the prior art. More specifically, martial arts weapons heretofore devised and utilized are known to consist basically of familiar, expected and obvious structural configurations, notwithstanding the myriad of designs encompassed by the crowded prior art which have been developed for the fulfillment of countless objectives and requirements.

Known prior art martial arts weapons include U.S. Pat. No. 5,066,013 to Kubota; U.S. Pat. No. 4,070,023 to Cutler; U.S. Pat. No. Des. 320,428 to Rust; U.S. Pat. No. 4,132,408 to Sabat; U.S. Pat. No. 5,344,158 to Gridley; and U.S. Pat. No. 4,682,774 to Holy.

While these devices fulfill their respective, particular objectives and requirements, the aforementioned patents do not disclose a new combination martial arts device. The inventive device includes a pair of elongated members. A pair of coupling bolts couple with the elongated members. The coupling bolts extend outwardly of the elongated members and have apertures therethrough inwardly of free ends thereof. A length of chain extends between the coupling bolts. The length of chain has free ends coupling with the apertures of the coupling bolts. A pair of handles extend outwardly from the elongated members.

In these respects, the combination martial arts device according to the present invention substantially departs from the conventional concepts and designs of the prior art, and in so doing provides an apparatus primarily developed for the purpose of combining a nunchaku and tonfa into a single weapon.

SUMMARY OF THE INVENTION

In view of the foregoing disadvantages inherent in the known types of martial arts weapons now present in the prior art, the present invention provides a new combination martial arts device construction wherein the same can be utilized for combining a nunchaku and tonfa into a single weapon.

The general purpose of the present invention, which will be described subsequently in greater detail, is to provide a new combination martial arts device apparatus and method which has many of the advantages of the martial arts weapons mentioned heretofore and many novel features that result in a new combination martial arts device which is not anticipated, rendered obvious, suggested, or even implied by any of the prior art martial arts weapons, either alone or in any combination thereof.

To attain this, the present invention generally comprises a pair of elongated members each having a rounded outer end and a square inner end. Each square inner end has a threaded bore extending inwardly thereof. Each threaded bore receives an externally threaded receiving collar therein. Each receiving collar has ball bearings disposed interiorly thereof. A pair of coupling bolts are provided with each having an interior portion and an exterior portion. The interior portions have a cylindrical configuration for being rotatably received within the receiving collars of the elongated members. The exterior portions extend outwardly of the receiving collars and have apertures therethrough inwardly of free ends thereof. A length of chain extends between the exterior portions of the coupling bolts. The length of chain has free ends coupling with the apertures of the exterior portions. A pair of handles extend outwardly from the elongated members inwardly of the rounded outer ends thereof. The pair of handles are disposed essentially in an orthogonal relationship with respect to the elongated members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination martial arts device apparatus and method which has many of the advantages of the martial arts weapons mentioned heretofore and many novel features that result in a new combination martial arts device which is not anticipated, rendered obvious, suggested, or even implied by any of the prior art martial arts weapons, either alone or in any combination thereof.

It is another object of the present invention to provide a new combination martial arts device which may be easily and efficiently manufactured and marketed.

It is a further object of the present invention to provide a new combination martial arts device which is of a durable and reliable construction.

An even further object of the present invention is to provide a new combination martial arts device which is susceptible of a low cost of manufacture with regard to both materials and labor, and which accordingly is then susceptible of low prices of sale to the consuming public, thereby making such combination martial arts device economically available to the buying public.

Still yet another object of the present invention is to provide a new combination martial arts device which provides in the apparatuses and methods of the prior art some of the advantages thereof, while simultaneously overcoming some of the disadvantages normally associated therewith.

Still another object of the present invention is to provide a new combination martial arts device for combining a nunchaku and tonfa into a single weapon.

Yet another object of the present invention is to provide a new combination martial arts device which includes a pair of elongated members. A pair of coupling bolts couple with the elongated members. The coupling bolts extend outwardly of the elongated members and have apertures therethrough inwardly of free ends thereof. A length of chain extends between the coupling bolts. The length of chain has free ends coupling with the apertures of the coupling bolts. A pair of handles extend outwardly from the elongated members.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
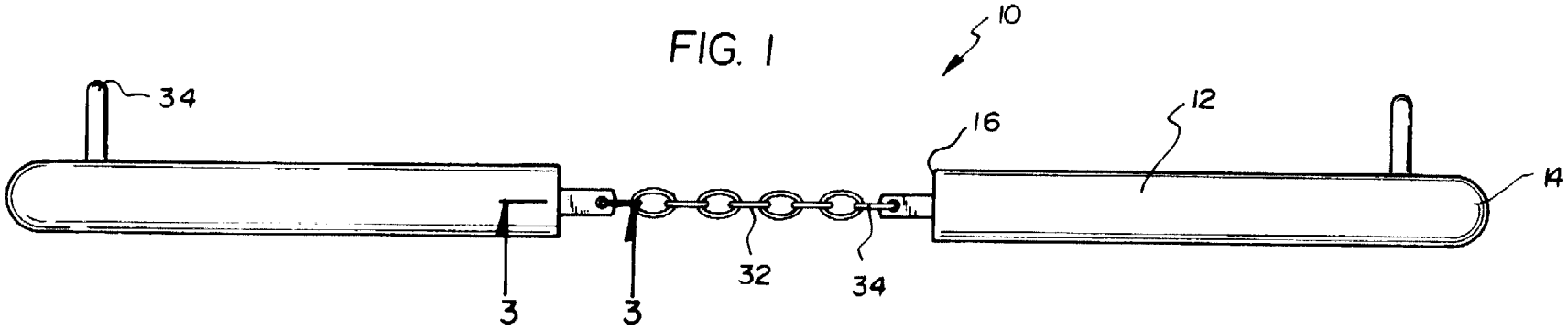
FIG. 1 is a side elevation view of a new combination martial arts device according to the present invention.
Figure 2:
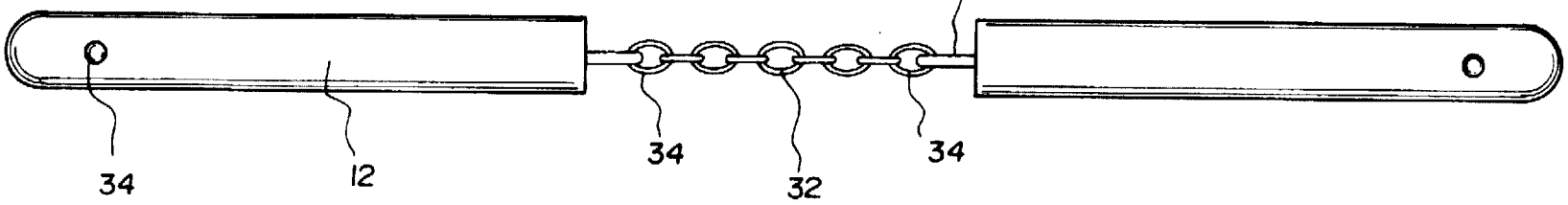
FIG. 2 is a top plan view of the present invention.
Figure 3:
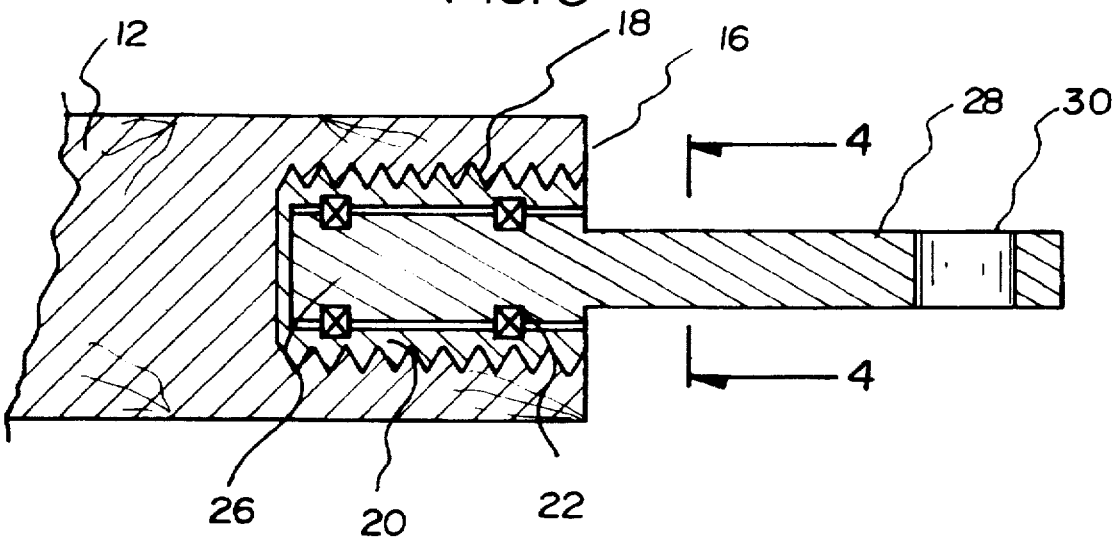
FIG. 3 is a cross-sectional view of the present invention as taken along line 3—3 of FIG. 1.
Figure 4:
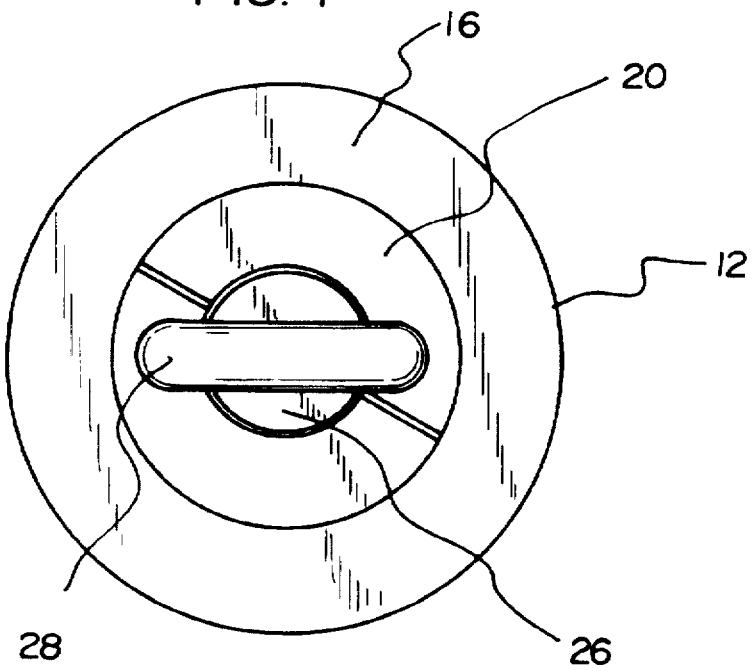
FIG. 4 is a cross-sectional view of the present invention as taken along line 4—4 of FIG. 3.

With reference now to the drawings, and in particular to FIGS. 1 through 4 thereof, a new combination martial arts device embodying the principles and concepts of the present invention and generally designated by the reference numeral 10 will be described.

As best illustrated in FIGS. 1 through 4, the combination martial arts device 10 comprises a pair of elongated members 12 each having a rounded outer end 14 and a square inner end 16. Each square inner end 16 has a threaded bore 18 extending inwardly thereof. Each threaded bore 18 receives an externally threaded receiving collar 20 therein. Each receiving collar 20 has ball bearings 22 disposed interiorly thereof.

A pair of coupling bolts 24 are provided with each having an interior portion 26 and an exterior portion 28. The interior portions 26 have a cylindrical configuration for being rotatably received within the receiving collars 20 of the elongated members 12. The exterior portions 28 extend outwardly of the receiving collars 20 and have apertures 30 therethrough inwardly of free ends thereof.

A length of chain 32 extends between the exterior portions 28 of the coupling bolts 24. The length of chain 32 has free ends 34 coupling with the apertures 30 of the exterior portions 28.

A pair of handles 34 extend outwardly from the elongated members 12 inwardly of the rounded outer ends 14 thereof. The pair of handles 34 are disposed essentially in an orthogonal relationship with respect to the elongated members 12.

In use, the device 10 would combine the nunchaku and the tonfa, two widely recognized martial arts weapons. In the hands of a well-trained individual, each weapon can be used to perform various highly effective offensive and defensive moves. The device 10 is designed to provide a new weapon that would be even more effective than the nunchaku or the tonfa since it would be a combination of each of these weapons. Like a pair of nunchaku, the device 10 would consist of the pair of elongated members 12 or hardwood sticks that are joined together by the length of chain 32. However each of the elongated members 12 would also include the handle 34 so that it could be held like a tonfa. This would allow the user to perform a wide range of new techniques and would make the device 10 even more effective.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new combination martial arts device for combining a nunchaku and tonfa into a single weapon comprising, in combination:

a pair of elongated members each having a rounded outer end and a square inner end, each square inner end having a threaded bore extending inwardly thereof, each threaded bore receiving an externally threaded receiving collar therein, each receiving collar having ball bearings disposed interiorly thereof;

a pair of coupling bolts each having an interior portion and an exterior portion, the interior portions having a cylindrical configuration for being rotatably received within the receiving collars of the elongated members, the exterior portions extending outwardly of the receiving collars and having apertures therethrough inwardly of free ends thereof;

a length of chain extending between the exterior portions of the coupling bolts, the length of chain having free ends coupling with the apertures of the exterior portions; and a pair of handles extending outwardly from the elongated members inwardly of the rounded outer ends thereof, the pair of handles being disposed essentially in an orthogonal relationship with respect to the elongated members.

2. A new combination martial arts device for combining a nunchaku and tonfa into a single weapon comprising, in combination:

a pair of elongated members;

a pair of coupling bolts coupling with the elongated members, the coupling bolts extending outwardly of the elongated members and having apertures therethrough inwardly of free ends thereof;

a length of chain extending between the coupling bolts, the length of chain having free ends coupling with the apertures of the coupling bolts; and a pair of handles extending outwardly from the elongated members.

3. The combination martial arts device as set forth in claim 2 wherein the pair of elongated members each have a rounded outer end and a square inner end, each square inner end having a threaded bore extending inwardly thereof, each threaded bore receiving an externally threaded receiving collar therein, each receiving collar having ball bearings disposed interiorly thereof, the receiving collar rotatably receiving the coupling bolts therein.

4. The combination martial arts device as set forth in claim 2 wherein the pair of handles are disposed essentially in an orthogonal relationship with respect to the elongated members.

* * * * *